US011827315B1

(12) United States Patent
Cavallaro et al.

(10) Patent No.: US 11,827,315 B1
(45) Date of Patent: Nov. 28, 2023

(54) LARGE APERTURE TOWED INFLATABLE PLANAR SENSOR PLATFORM

(71) Applicant: The United States of America as represented by the Secretary of the Navy, Newport, RI (US)

(72) Inventors: Paul V Cavallaro, Raynham, MA (US); Michael P Smith, Warwick, RI (US); Nicholas A Valm, Dartmouth, MA (US)

(73) Assignee: The United States of America as represented by the Secretary of the Navy

( * ) Notice: Subject to any disclaimer, the term of this patent is extended or adjusted under 35 U.S.C. 154(b) by 352 days.

(21) Appl. No.: 17/394,443

(22) Filed: Aug. 5, 2021

Related U.S. Application Data

(60) Provisional application No. 63/072,956, filed on Sep. 1, 2020.

(51) Int. Cl.

| | |
|---|---|
| ***B63B 22/22*** | (2006.01) |
| ***B63B 7/08*** | (2020.01) |
| ***B63B 22/20*** | (2006.01) |
| ***B63B 22/00*** | (2006.01) |

(52) U.S. Cl.
CPC ..... *B63B 22/22* (2013.01); *B63B 7/082* (2013.01); *B63B 22/20* (2013.01); *B63B 2022/006* (2013.01)

(58) Field of Classification Search
CPC .... B63B 7/00; B63B 7/06; B63B 7/08; B63B 7/082; B63B 22/00; B63B 22/003; B63B 22/18; B63B 22/20; B63B 2022/006
USPC .... 441/1, 21, 22, 23, 28, 29, 30, 35, 40, 65, 441/66, 79; 114/121, 125, 242, 243, 253, 114/264, 266, 267
See application file for complete search history.

(56) References Cited

U.S. PATENT DOCUMENTS

| | | | | |
|---|---|---|---|---|
| 5,517,938 A * | 5/1996 | Wood | B63B 21/66 114/244 |
| 6,588,465 B1 * | 7/2003 | Kirkland | B64D 39/04 244/113 |
| 10,114,136 B2 * | 10/2018 | Boberg | G01V 1/3808 |

* cited by examiner

*Primary Examiner* — Daniel V Venne
(74) *Attorney, Agent, or Firm* — James M. Kasischke; Michael P. Stanley; Jeffry C. Severson

(57) ABSTRACT

A sensor platform is provided with a rigid hull having a planar shape having a bow, stern, a port and a starboard side. The platform includes an inflatable perimeter tube having sides extending along a perimeter of the hull. A tow connection is at the bow and rigid control surfaces are at the stern. A planar sensor array is disposed within the platform. The planar sensor array includes inflatable sensor panels attached to the port and a starboard side of the perimeter tube. Each of the inflatable sensor panels has a plurality of sensors embedded with electrical conductors for power and data transfer. A manifold disposed within the platform operationally connects to the inflatable perimeter tube and the inflatable sensor panels. An electrical controller disposed within the platform connects to the sensors and the manifold.

8 Claims, 12 Drawing Sheets

LARGE APERTURE TOWED INFLATABLE PLANAR SENSOR PLATFORM

The present application claims the benefit of U.S. Provisional Patent Application Ser. No. 63/072,956 filed on Sep. 1, 2020 with the invention entitled "TOWED INFLATABLE PLANAR PLATFORM STRUCTURE FOR HOUSING USW/ASW SENSORS" by the inventors Paul V. Cavallaro, Michael P. Smith and Nicholas A. Valm.

STATEMENT OF GOVERNMENT INTEREST

The invention described herein was made in the performance of official duties by employees of the U.S. Department of the Navy and may be manufactured, used, or licensed by or for the Government of the United States for any governmental purpose without payment of any royalties thereon.

BACKGROUND OF THE INVENTION

1) Field of the Invention

The present invention is directed to inflatable soft structures and more particularly to a robust, deployable soft inflatable platform capable of handling towed large aperture sensor arrays.

2) Description of the Related Art

Arrays are towed for sensing sound below the ocean surface. Typically, such arrays are linear assemblies of modules. Hydrophones or other sensors mount in the module sections. Sound pressure waves pass through the wall of various sections where the hydrophones sense pressure fluctuations and transform the sensed pressures into electrical signals. The electrical signals transmit to a support vessel.

Other arrays, known as large aperture arrays, are also used for sensing.

SUMMARY OF THE INVENTION

The present invention discloses a structurally robust and deployable platform with a generally planar hull shape. The platform is configured with sensor arrays, hydrodynamic shaping and control surfaces with the platform capable of controlled vertical or horizontal alignment in a water column.

The air-inflated rigid hull platform enables launch and recovery operations by using small craft handling equipment. Once launched from a host surface vessel, the platform remains attached to the vessel by a tow cable and floats on the water surface. Air is released from the platform to shift the center of buoyancy outboard from a longitudinal centerline of the platform.

The platform is then ballasted with water to an inflation pressure of approximately 100.0 psig above ambient depth pressure. The platform becomes neutrally or negatively buoyant as needed. When negatively buoyant, the platform submerges and rotates such that the orientation of the sensor array aligns to the vertical direction of the water column for towed operational sensing.

For recovery, water is released from the platform and is re-inflated with air to achieve buoyancy and rigidity in order to float the platform to the water surface. Recovery is performed using conventional small craft handling methods from a host surface vessel. Once onboard the host surface vessel, the platform is deflated and can be disassembled for stowage.

The sensor platform includes a preferably rigid inflatable structure having a generally planar hull shape with a front end and a back end. The platform also has an inflatable perimeter tube having right and left sides extending along the perimeter tube, a tow connection at the front end, and rigid or rigid inflatable control surfaces at the back end with a planar sensor array positioned within the platform. The planar sensor array further includes a plurality of inflatable sensor panels attached to the right and left sides of the perimeter tube. Each of the inflatable sensor panels has a plurality of sensors. If the platform includes multiple sensor panels, the sensor panels are arranged as a layered stack. The stacking arrangement may include optional spacing between sensor panels. The spacing between panels allows the external fluid to cool the sensors and achieve ambient temperature at the operational depth. Fluid cooling also minimizes thermal gradients between sensors.

A manifold is disposed within the platform. The manifold operationally connects to the inflatable perimeter tube and the sensor panels with an electrical controller within the platform. The electrical controller operationally connects to the sensors and the manifold.

The controller can instruct the manifold to release air from the inflatable tube to shift a center of buoyancy of the platform outboard from a longitudinal centerline of the platform. Then, the controller instructs the manifold to ballast the platform such that the platform submerges and rotates to orient the platform perpendicular to the water surface.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
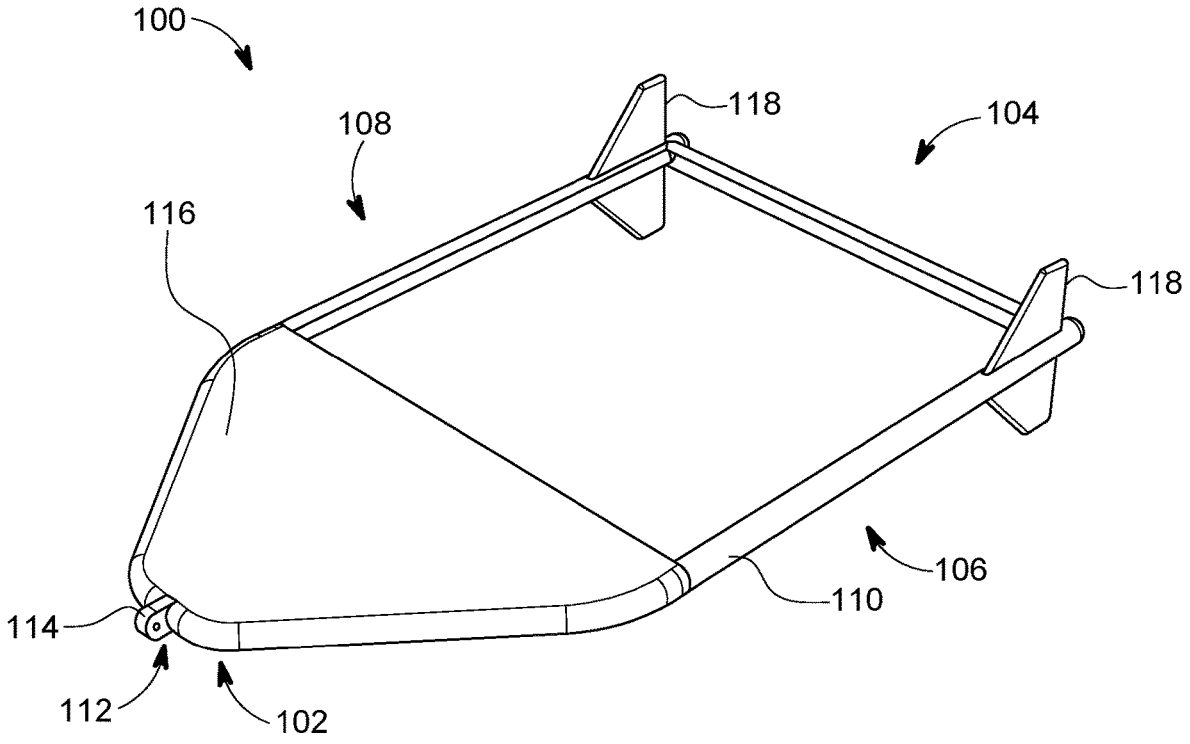
FIG. 1 depicts a frame of the present invention.

Referring to the drawings, FIG. 1 depicts a hull 100 having a substantially planar shape with a bow 102, a stern 104, a port side 106 and a starboard side 108. The hull 100 includes a cylindrical perimeter tube 110 that can inflate along a perimeter of the hull. The perimeter tube 110 includes a nose 112 at the bow 102 where a tow cable connection point 114 is affixed. The tow cable connection point 114 and platform region 116 proximate to the perimeter tube 110 is reinforced with high performance fabrics to provide increased strength and stiffness as well as preventing localized deformations in the hull 100.

Rigid or rigid inflatable control surfaces 118 attach to the perimeter tube 110 adjacent to the stern 104. In an embodiment, the hull 100 has dimensions within a range of a thirty foot length with a twenty foot width and a two foot depth. The perimeter tube 110 may be constructed of circular woven (seamless) high performance fabrics and connectors and may be multi-jacketed using a double layer arrangement. This type of construction allows sufficient inflation pressure for the perimeter tube 110 to maintain a shape and to maintain sensor positional tolerances when the platform is subjected to hydrostatic depth pressures and hydrodynamic tow loads.

Figure 2:
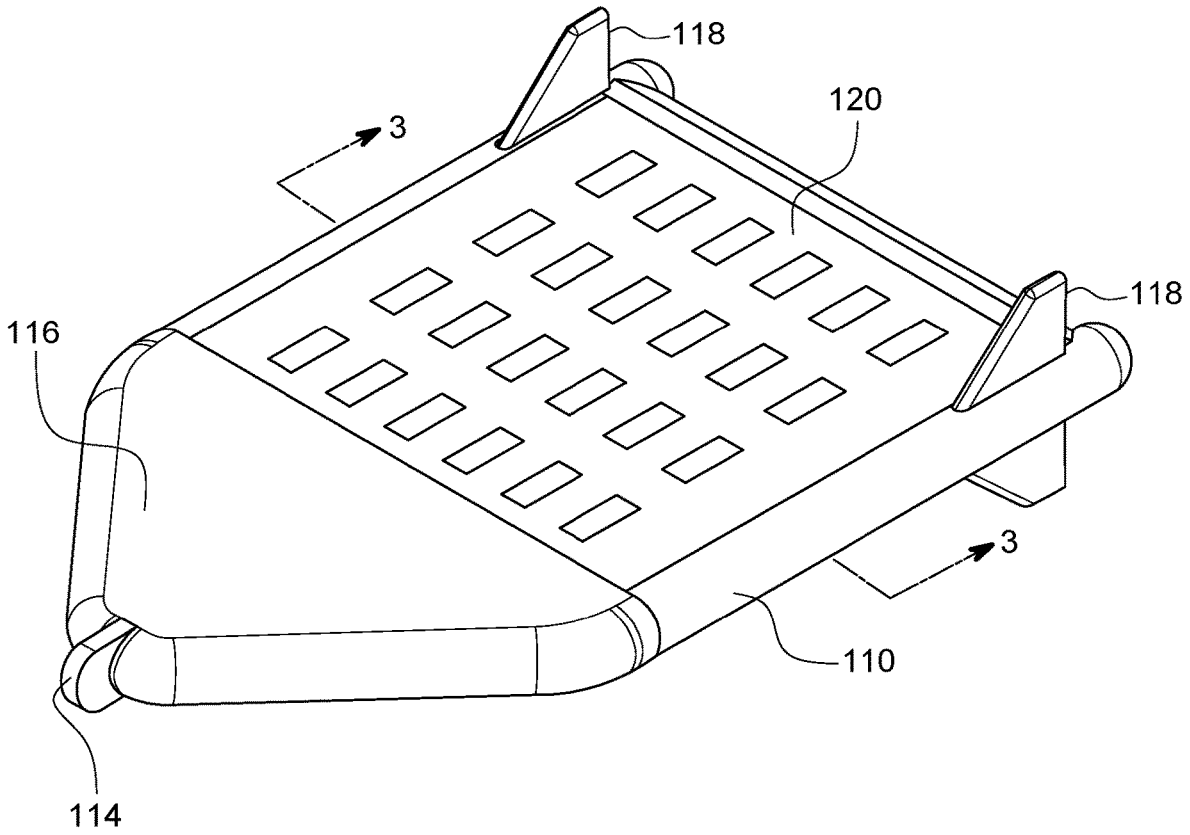
FIG. 2 is a perspective view of an inflatable sensor platform of the present invention.

As shown in FIG. 2, an interior region of the perimeter tube 110 attaches to flat panels 120 using removable connections (i.e., zippers, lacing, etc.) such that disassembly of the flat panels from the perimeter tube is enabled for compact stowage, repair, and reconfiguration. The flat panels 120 may include one or more inflatable stacked panels.

Figure 3:
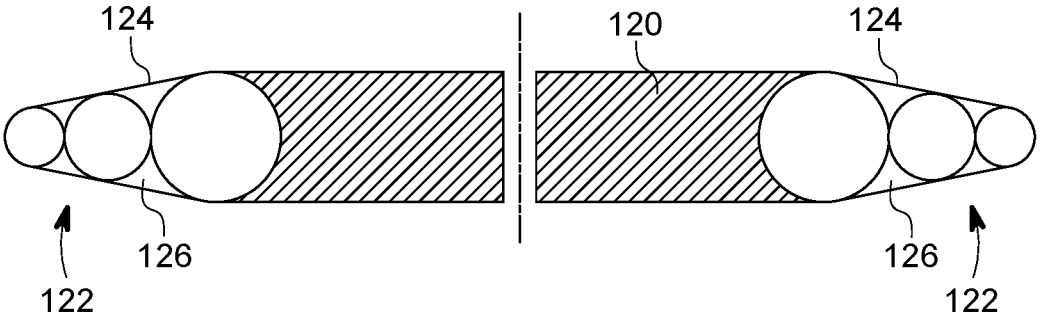
FIG. 3 is a cross-sectional view of the sensor platform and perimeter tube with the view taken along reference lines 3-3 of FIG. 2.

As shown in FIG. 3 and for improved hydrodynamic performance, the perimeter tube 110 is an assembly 122 having multiple tubes arranged side-by-side by decreasing diameters to form a hydrofoil-like design. The multi-tube assembly 122 is wrapped in a layer 124 of high performance fabric with internal regions 126 filled with foam or other accommodating material. The multi-tube assembly 122 reduces drag, self-noise, and wake effects. Torsional stiffness can be increased for hydrodynamic stability by incorporating bias (off-axis) fabric plies in the skins of the perimeter tube 110.

Figure 4:
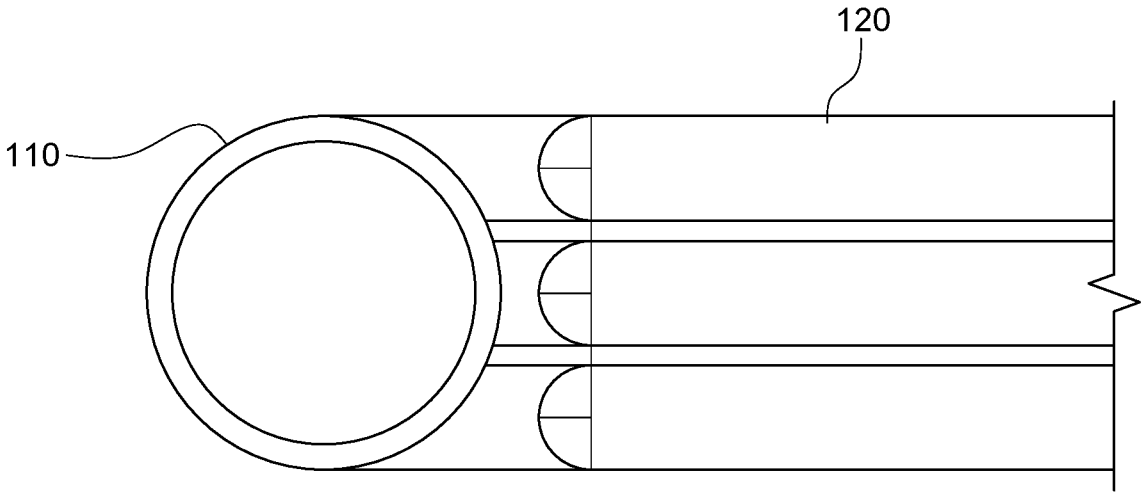
FIG. 4 is a cut-away view of panel connections of the present invention.

The flat panels 120 connect to the perimeter tube 110 using zippers, which allow for disassembly, or a thermoplastic urethane (TPU) molded connector for bonding the panels to the perimeter tube 110. FIG. 4 depicts an example of three stacked inflatable panels 120 attached to the perimeter tube 110 and arranged with a nominal 1.0-inch or other suitable gap between each inflatable panel.

Figure 5:
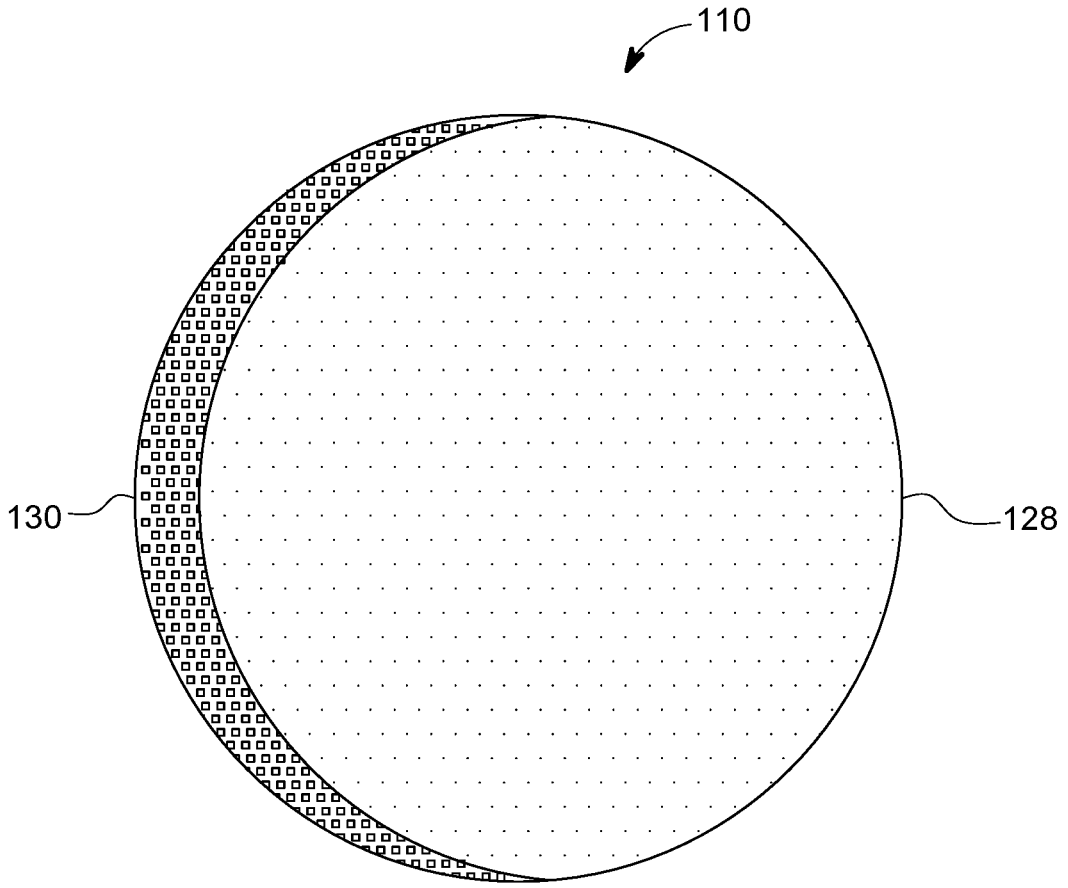
FIG. 5 is a cut-away view of a perimeter tube of the present invention for launch and recovery operations.
Figure 6:
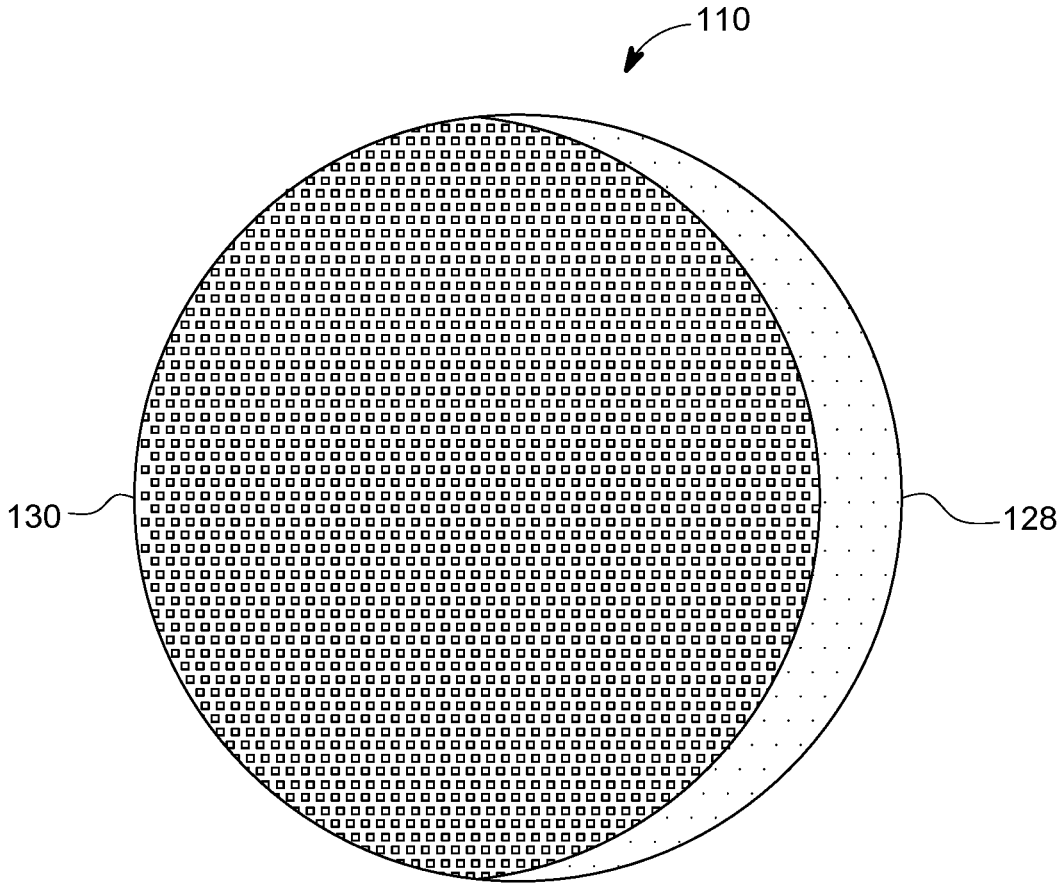
FIG. 6 is a cut-away view of the perimeter tube of the present invention for submerged operations.

Referring to the cross-sectional views of FIG. 5 and FIG. 6, the perimeter tube 110 contains one or more internal bladders; a first internal bladder 128 is for pressurization with air and a second internal bladder 130 is for pressurization with water. The individual bladders are constructed of air-impermeable and water-impermeable hyper-elastic materials (silicone, thermoplastic urethane, etc.) and can be divided into multiple segments along their length. Each internal bladder segment operates independently using fill/drain valves to provide pressurization control and structural redundancy.

The inflatable components include a cylindrical perimeter fabric tube and flat fabric panels. Each is preferably constructed of high performance fabrics such as VECTRAN (liquid crystal polymer), DSP (dimensionally stable polyester), PEN (polyethylene napthalate), SPECTRA and DYNEEMA (ultra-high molecular weight polyethylenes), KEVLAR (aramid), and others, that are woven, braided, knitted or constructed with other textile processing methods and fiber placement architectures known to those skilled in the art.

The inflatable components may include additional structural reinforcement members to achieve increased tensile and shear stiffnesses and strengths, increased damage tolerance, enhanced shape control for hydrostatic and hydrodynamic loadings, sensor-to-sensor positional tolerances and increased inflation pressure capacities.

The stiffness, strength and damage tolerance of the perimeter tube 110 and flat panels 120 can be enhanced by attaching (i.e., bonding, RF welding, etc.) high stiffness, high strength fiber layers embedded in a thermoplastic matrix. The fiber-reinforced thermoplastic layers, referred to as a soft composite, are generally anisotropic and optimally align in a unidirectional or multidirectional orientation and retain minimal bending stiffness. When attached to inflated perimeter tubes and inflated flat panels, these soft composites produce a four-fold or higher increase in tube and panel bending stiffnesses due to the increase in the $2^{nd}$ Area Moment of Inertia in accordance with the Parallel Axis Theorem but when deflated permit the inflatable tube and panel to collapse and be compacted for storage.

Regions requiring localized strengthening such as valve insertion points, connections, joints, etc. can be reinforced with doublers including fabric layers or thin films that can be stitched, radio frequency welded, or attached using methods known to those skilled in the art.

Figure 7:
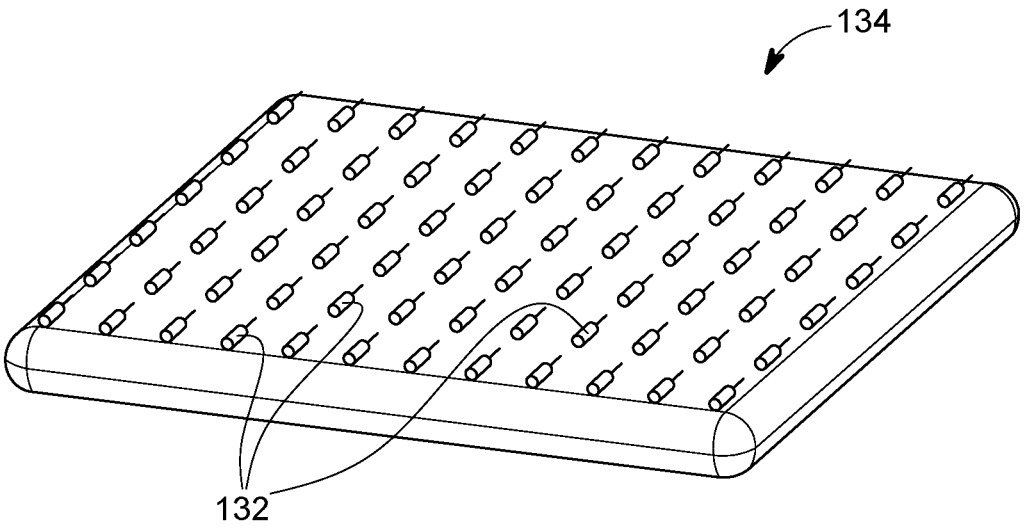
FIG. 7 shows a flat panel embodiment of an inflatable sensor platform.

As shown in FIG. 7, the flat panels are configured with sensors 132 (i.e.; acoustic, velocity, etc.). The sensors 132 form a sensor suite or sensor array 134 and attach to the flat panels. Electrical conductors from the electrical controller to the sensors provide for power and data transfer. A second flat panel (not shown) attaches to the top of the sensor array 134. Direct lamination can be used with two of the flat panels 120 to form a sandwich with the sensors 132 bonded between them. This will produce a balanced inflatable flat panel construction that is hydro-dynamically smooth on the outer surfaces to minimize flow noise.

Alternatively, a coated fabric skin layer could sandwich the sensors 132 bonded to one side of a single inflatable flat panel with an optional coated fabric skin layer sandwiching the sensors bonded on the opposite side of the flat panel. The conductors for the sensors 132 extend from their respective sensor location to the edges of the flat panels 120 where the conductors route to flat panel/perimeter tube interface connections.

Figure 8:
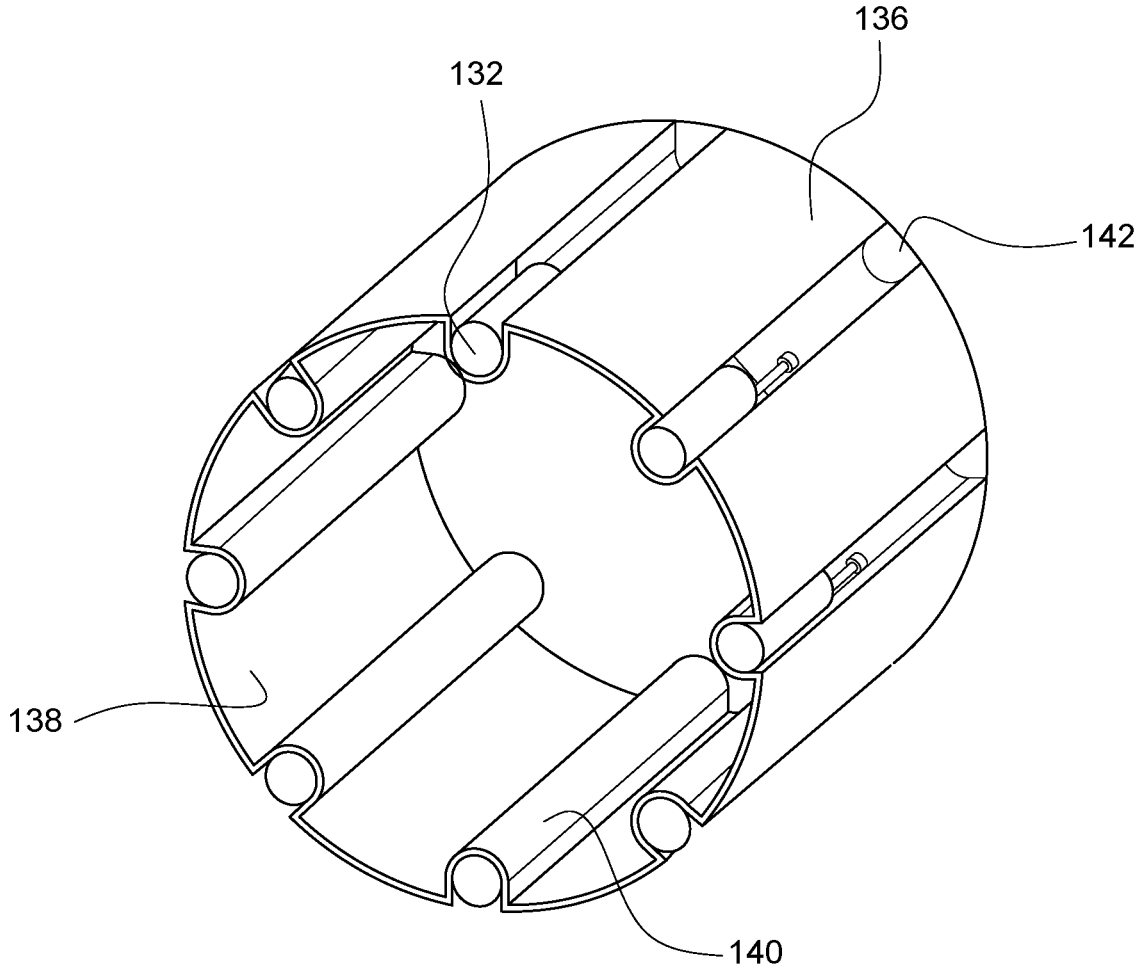
FIG. 8 is a perspective view of sensor integration inside an inflatable tube.

FIG. 8 depicts an integration of the sensor 132 inside an inflatable tube 136. The inflatable tube 136 contains a liner 138 with sensor pockets 140. The sensors 132 are installed in a continuous array along the length of the inflatable tube 136. Foam 142 or other accommodating material is placed between the sensors 132 along the length of the inflatable tube 136 to maintain sensor spacing and position. The use of open cell foam placed between coaxially aligned sensors 132 maintains sensor positional tolerances during hydrostatic and hydrodynamic loadings.

Figure 9:
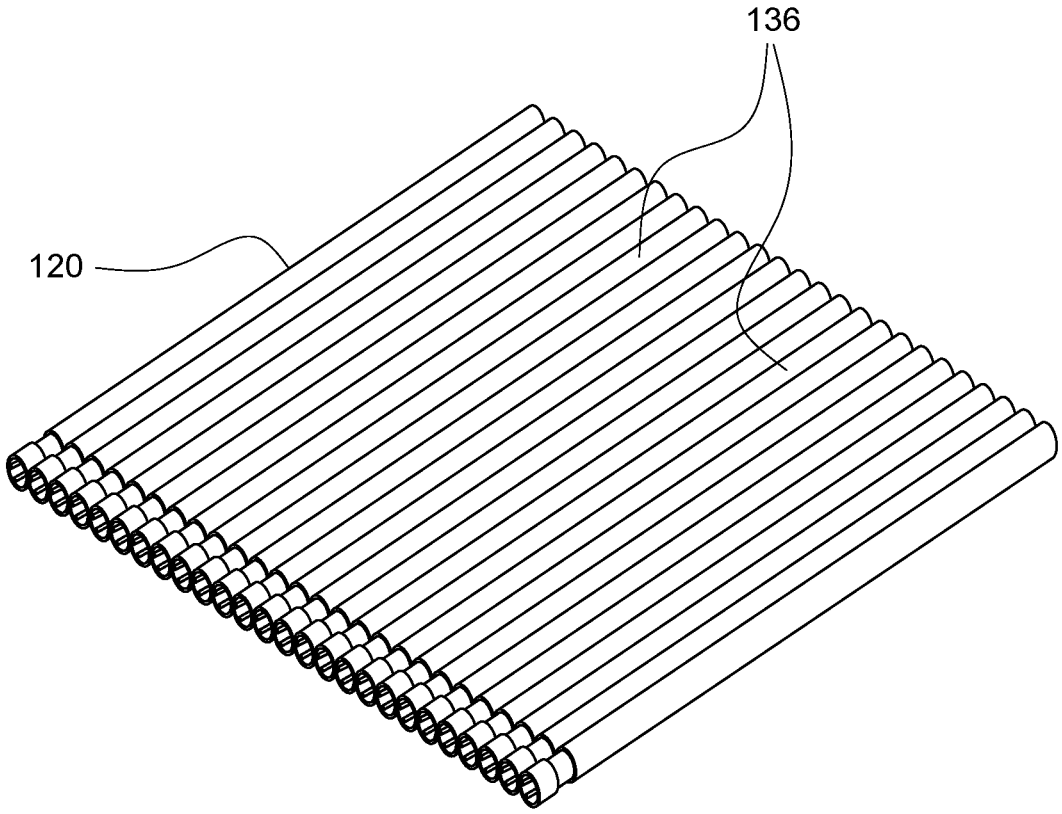
FIG. 9 depicts a plurality of tubes arranged in a flat panel of an inflatable sensor platform.

An inflatable fabric wrap (not shown) secures the sensors 132 and the liner 138 in the inflatable tube 136. A plurality of inflatable tubes 136 can align, as shown in FIG. 9, to form the flat panel 120. The inflatable tubes 136 have an outer wrap layer (144 in FIG. 11) that is hydrodynamically smooth on the outer surfaces to minimize flow noise when towed. The conductors for the sensors 132 extend from their respective sensor location to the edges of the flat panel 120 where the conductors route to flat panel/perimeter tube interface connections.

Figure 10:
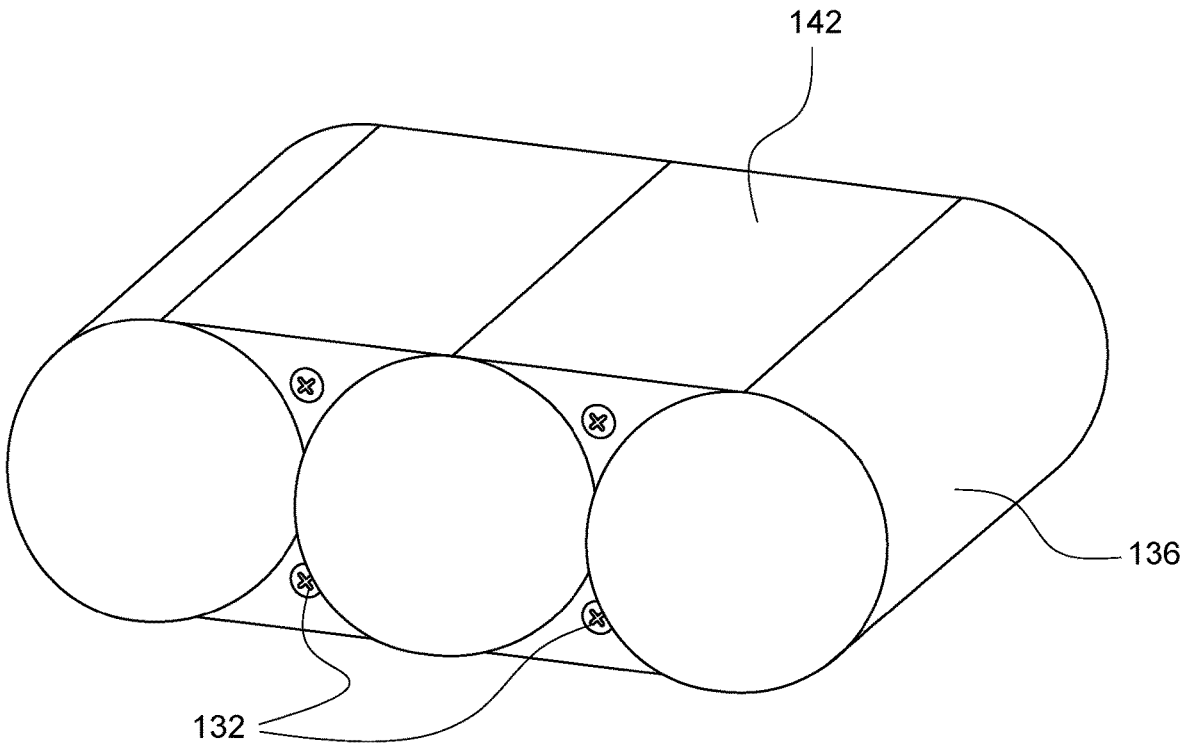
FIG. 10 is a perspective view of sensor integration outside an inflatable tube.

In another arrangement shown in FIG. 10, the sensors 132 are placed interstitially outside the inflatable tubes 136. As described above, the foam 142 or other appropriate material is placed between and along the length of the inflatable tubes 136 to secure the sensors 132 and maintain sensor spacing and position. The use of open cell foam placed between coaxially aligned sensors 132 maintains sensor positional tolerances during hydrostatic and hydrodynamic loads.

Figure 11:
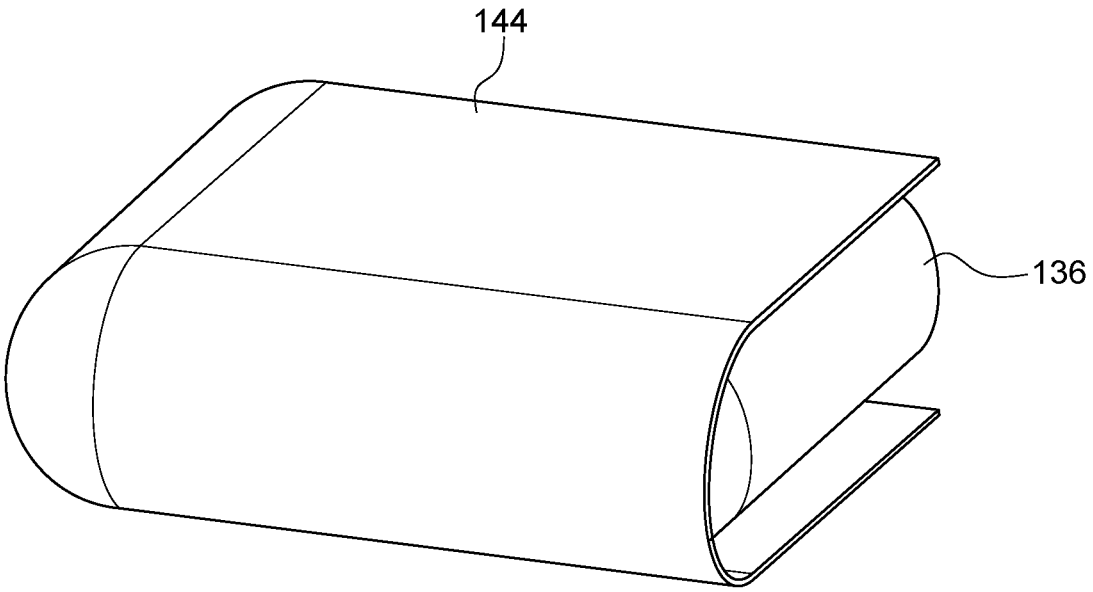
FIG. 11 depicts a plurality of tubes with an outer layer arranged in a flat panel of an inflatable sensor platform.

As shown in FIG. 11, the inflatable tubes 136 have an outer wrap layer 144 that is hydro-dynamically smooth on the outer surfaces to minimize flow noise. The conductors for the sensors 132 extend from their respective sensor location to the edges of the flat panel 120 where the conductors route to flat panel/perimeter tube interface connections.

Figure 12:
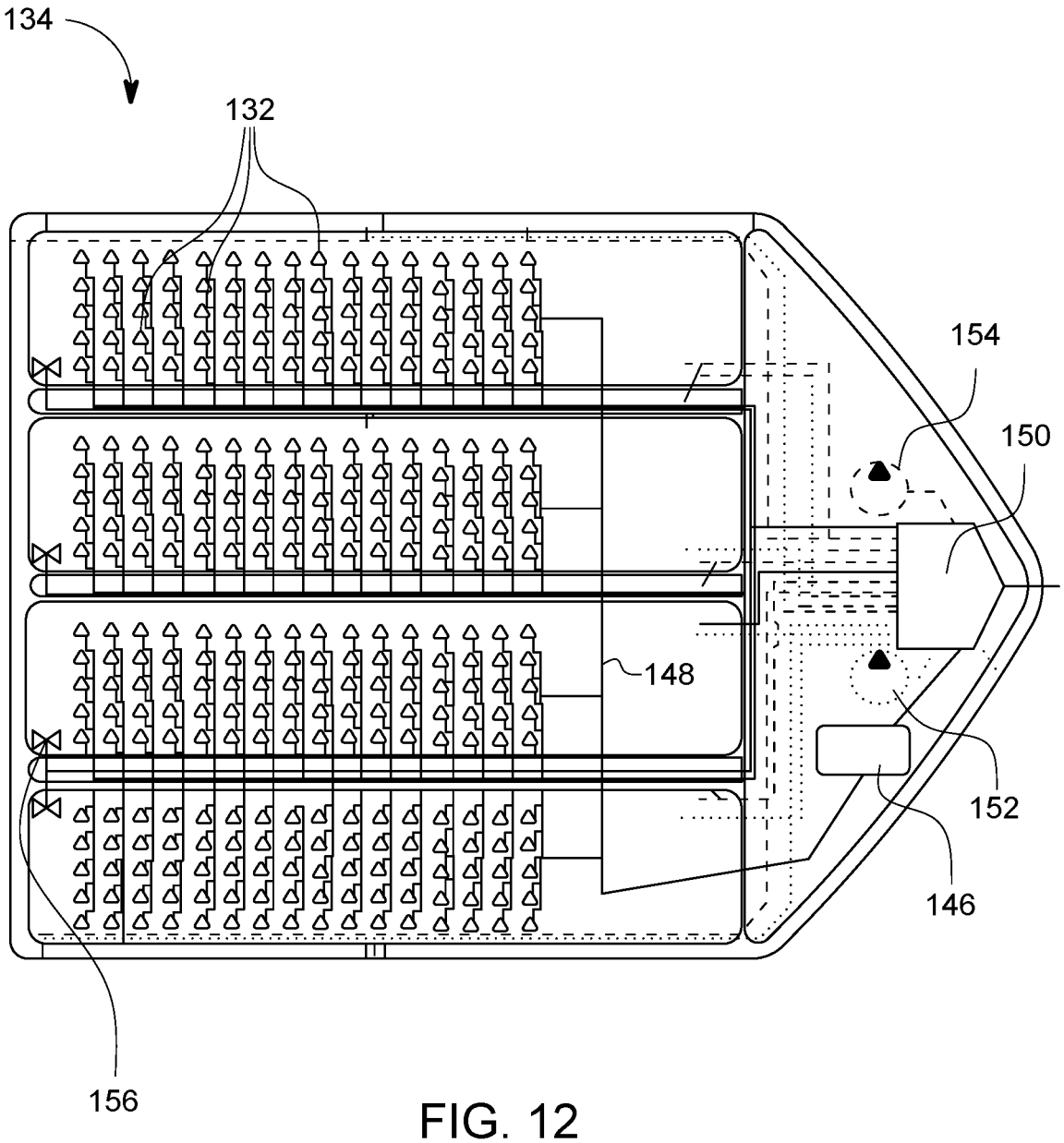
FIG. 12 is a schematic diagram of integrated sensors and components of the present invention.

FIG. 12 is a schematic of the routing paths for the various components of an inflatable sensor platform according to the present invention. The figure illustrates the embedded sensor locations, networked electronics, and air and water connections. The sensor array 134 includes a plurality of sensors 132 connected to a controller 146 by electrical power and data lines 148. The inflatable components are pressurized using a manifold 150 connected to a gas generator 152 (e.g., a cold gas generator) for air supply and a water pump 154. The manifold 150, gas generator 152, and water pump 154 are located in the surrounding region 116 adjacent to the tow cable connection point 114 (See FIG. 2).

Optionally, air and water can be provided to the hull 100 by using air and water supply lines connected from a host surface vessel through the tow cable. The manifold 150 sequences and regulates the supplies of air and water to the perimeter tube 110 and flat panels 120 and includes pressure relief/fill valves to prevent over/under inflation. The inflatable components and manifold system provide structural redundancy to the hull 100 to facilitate continuous operational capability should an inflatable chamber within the perimeter tube 110 fail.

Connections for electrical (power and data), air and water plumbing are present at the interfaces between the flat panels 120 and the perimeter tube 110. The connections are regulated using the manifold 150 and the controller 146.

Once the perimeter tube 110 and flat panels 120 inflate with air and the tow cable is connected; the hull 100 is launched from the host surface vessel and floats horizontally on the water surface. To prepare for operational use after launch from the host surface vessel and while the platform is floating on the free surface; the majority of air pressure is released and the inflatable compartments are ballasted to submerge the platform. The inflatable compartments are pressurized with water (up to 100.0 psig or higher as necessary above ambient depth pressure) to maintain a stiffness necessary for shape keeping and sensor positioning tolerances (+/−1.0-cm) against hydrostatic pressures and hydrodynamic tow forces.

That is, the pressurized air is released through valves 156 and water is pumped inside the inflatable compartments of the perimeter tube 110 and flat panels 120 for ballasting by using the water pump 154 or by using a water supply line through the tow cable. Air is released from all but select internal bladders of the perimeter tube 110 on one side of the platform such that a minimal volume of air is maintained in one or more select compartments of the inflatable perimeter tube 110 to offset the center of buoyancy outboard from the longitudinal centerline.

Thus, the center of buoyancy shifts away from the centerline along an athwartship direction forcing the platform to rotate 90-degrees and to achieve a vertical orientation in the water column as required to vertically orient the flat panel sensor arrays for proper sensor detection and tracking operations. The internal air and water pressures are continuously regulated by the manifold 150 to maintain constant inflation pressures over ambient depth pressure using pressure relief/fill valves such that sufficient stiffness is provided and shape keeping and sensor positional tolerances are maintained during hydrostatic and hydrodynamic loadings.

The platform is configured with multiple independent inflatable chambers (cylindrical perimeter tube and flat panels), sensors 132, a controller 146 with power and data distribution connections, a tow cable with water and air fill lines (or optional onboard gas generators and water pumps), air and water fill/drain valves and a manifold 150 that controls and regulates the air and water inflation pressures. When internally pressurized, the platform develops sufficient stiffness and shape keeping to form a hydrodynamic shape that is rigid and stable.

The perimeter tube 110 may be configured with segmented internal bladders for added ballasting controls and redundancy. The perimeter tube 110 and flat panels 120 are laminated with flexible coatings to protect the fabrics against impacts, abrasion, and environmental effects while allowing the perimeter tube and flat panels to behave as membrane materials for achieving compactness when deflated and stowed. With regard to the flat panels 120, the laminated coating also serves as an air-impermeable barrier and a water-impermeable barrier to contain internal pressure. The inflatable perimeter tube 110 provides cushioning protection to the flat panels 120 and the sensor system against impact and handling forces.

Inflatable fabric (or other membrane) materials provide the platform with a unique fail-safe structural performance advantage that is not achievable for platforms constructed with conventional rigid materials.

However, an inflatable fabric platform will simply wrinkle and collapse during an overload event. Wrinkling and collapse are fully elastic and recoverable. Upon removal of the overload, the inflatable platform returns to an original operational shape without inflicting damage to the inflated fabric components. Onset of the fail-safe behavior mode is readily established to achieve a survivable tow speed requirement through knowledge of the inflation pressure over ambient depth pressure and the hydrostatic pressures and shear forces on the platform surfaces.

Inflated fabric cylinders also provide an advantage over inflated drop stitch panels. Pressurization of an inflatable cylinder produces a developable shape that remains cylindrical and yields a 2:1 stress per unit distance ratio along the hoop and axial (longitudinal) axes, respectively. Pressurization of an inflated drop stitch panel produces a flat panel.

However, concerns arise from the use of inflated drop stitch panels. First, significantly higher operating pressures are attainable with cylindrical fabric preforms compared to drop stitch fabric preforms. Second, if drop yarn tensile failures occur due to over-inflation, local expansion of the panel thickness occurs and herniated deformations develop. If the quantity of drop yarn failures is significant, these deformations can affect sensor positional tolerances that may degrade sensor array performance.

An inflated drop stitch panel transforms from a flat geometry to a cylinder having a diameter larger than the initial drop stitch panel thickness. The perimeter of the drop stitch panel becomes the diameter of the cylinder as material length is conserved for inextensible fabrics.

Furthermore, the panel will emit acoustic energy with increasing drop yarns failures. The internal pressure will decrease as the internal volume increases. If damage is confined to the drop yarns only and the panel can support internal pressure; the panel will continue to support structural loads although at a reduced stiffness capacity and can permit recovery of the platform. This behavior represents a partial fail-safe mode. It is clear that inflatable fabric structures can be used to achieve unique and controllable failures that offer fail-safe and partial fail-safe advantages.

The in-plane shearing stiffness and stability of the flat panel skins, drop stitch fabrics, tubular membranes, and fabric spars can be increased by adding bias (off-axis) plies to each. Tubes in the stacked tubular membrane construction method may be fabricated using fire hose construction and connection methods to achieve operational pressures capable of exceeding 100 psig.

The platform is disassembled at the zippered connections and compactly stowed within a storage container having an internal volume markedly smaller than that of the inflated platform to enable efficient packing for stowage and transport. In operation, the container is unpacked and the perimeter tube 110 is placed on the deck of the host surface vessel. The perimeter tube 110 is inflated with air to an initial pressure (5.0-10.0 psig) for launch. The flat panels are positioned within the footprint of the perimeter tube 110 and are secured to the same using the zippers or other detachable connection means.

The electrical connections are joined between the perimeter tube 110 and flat panels. The tow cable (not shown), which includes electrical conductors for power and data transfer from/to the host surface vessel, is attached to the platform nose tow point 114 and ported through the perimeter tube 110 and zippered interfaces to the electrical controller to the inflatable flat panels. The flat panels are inflated with air to an initial pressure for rigidity needed during launch.

Rigid and hybrid soft/rigid versions of the hull 100 are variations that can support launch, recovery and operational modes described herein when constructed of all rigid materials (metals, composites, plastics, etc.) or hybrid soft/rigid mix of materials.

The hull 100 can be used as a soft (or rigid) autonomous underwater vehicle and a sea glider having large aperture sensor arrays when fitted with energy sources and a propulsion system. The use of photovoltaic skins and embedded/deployable antenna systems can provide recharging capabilities and data transfer when the autonomous platform is at the water surface.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A water and air stabilized sensor platform for use on a body of water comprising:

a hull with a longitudinal centerline with said hull having a planar shape with a first end and a second end;

an inflatable tube having a first side and a second side extending along a perimeter of said hull;

a planar sensor array disposed within said hull with a plurality of inflatable sensor panels attached to the first side and the second side of said inflatable tube, each of said plurality of inflatable sensor panels having a plurality of sensors;

a manifold disposed within said hull, said manifold connected to said inflatable tube and operationally connected to said plurality of inflatable sensor panels;

a water pump disposed within said hull, said water pump fluidly connected to said manifold, said inflatable tube, and said plurality of inflatable sensor panels;

a gas generator disposed within said hull, said gas generator fluidly connected to said manifold, said inflatable tube, and said plurality of inflatable sensor panels; and a controller disposed within said hull, said controller operationally connected to said plurality of sensors, said manifold, said water pump, and said gas generator;

wherein said controller causes said manifold to release air from said inflatable tube to shift a center of buoyancy of said hull outboard from the longitudinal centerline of said hull; and wherein said controller causes said manifold to ballast said hull with water such that said hull submerges in the body of water and said hull rotates to orient said planar sensor array perpendicular to a surface of the body of water.

2. The sensor platform in accordance with claim 1, wherein said inflatable tube further comprises:

a first internal bladder configured for pressurization of said inflatable tube with air; and a second internal bladder configured for pressurization of said inflatable tube with water.

3. The sensor platform in accordance with claim 1, wherein said inflatable tube includes a tow connection at the first end and wherein said inflatable tube further comprises rigid inflatable control surfaces extending from and perpendicular to the second end.

4. The sensor platform in accordance with claim 3, said planar sensor array further comprising:

a first inflatable flat panel having said plurality of sensors embedded therein; and a second inflatable flat panel attachable to said first inflatable flat panel;

wherein said planar sensor array is embedded with electrical conductors for power and data transfer with said planar sensor array sandwiched between said first inflatable flat panel and said second inflatable flat panel.

5. The sensor platform in accordance with claim 3, said planar sensor array further comprising:

a plurality of inflatable tubes arranged side-by-side to form a flat plane panel, wherein said plurality of sensors are installed in a continuous array along the length of each of said plurality of inflatable tubes;

spacing material is placed between adjacent sensors along the length of each of said plurality of inflatable tubes; and a hydrodynamically smooth wrap layer encompassing said plurality of inflatable tubes.

6. The sensor platform in accordance with claim 1, wherein said inflatable tube includes a tow connection at the first end and wherein said inflatable tube further comprises rigid surfaces extending from and perpendicular to the second end.

7. The sensor platform in accordance with claim 6, said planar sensor array further comprising:

a first inflatable flat panel having said plurality of sensors embedded therein; and a second inflatable flat panel attachable to said first inflatable flat panel;

wherein said planar sensor array is embedded with electrical conductors for power and data transfer with said planar sensor array sandwiched between said first inflatable flat panel and said second inflatable flat panel.

8. The sensor platform in accordance with claim 6, said planar sensor array further comprising:

a plurality of inflatable tubes arranged side-by-side to form a flat plane panel, wherein said plurality of sensors are installed in a continuous array along the length of each of said plurality of inflatable tubes;

spacing material is placed between adjacent sensors along the length of each of said plurality said inflatable tubes; and a hydrodynamically smooth wrap layer encompassing said plurality of inflatable tubes.

* * * * *